US006681537B2

(12) United States Patent
Queirel

(10) Patent No.: US 6,681,537 B2
(45) Date of Patent: Jan. 27, 2004

(54) PROCESS FOR THE IMPLEMENTATION OF CIVIL ENGINEERING WORKS, SWIMMING POOLS AND WATER TANKS IN PARTICULAR, AND MEANS FOR ITS IMPLEMENTATION

(76) Inventor: Joel Queirel, 19 rue Jules Lebocey, Troyes, 10000 (FR)

( * ) Notice: Subject to any disclaimer, the term of this patent is extended or adjusted under 35 U.S.C. 154(b) by 41 days.

(21) Appl. No.: 10/026,733

(22) Filed: Dec. 27, 2001

(65) Prior Publication Data

US 2002/0083664 A1 Jul. 4, 2002

(30) Foreign Application Priority Data

Jan. 2, 2001 (FR) ..... 01 00014

(51) Int. Cl.[7] ..... E04B 1/00
(52) U.S. Cl. ..... 52/274
(58) Field of Search ..... 52/169.7, 293.1, 52/294, 299, 319, 327, 353, 383, 585.1, 507, 508; 249/34, 38

(56) References Cited

U.S. PATENT DOCUMENTS 3,745,593 A * 7/1973 Wall ..... 4/172.19
5,111,628 A * 5/1992 Desjoyaux et al. ..... 52/169.7

FOREIGN PATENT DOCUMENTS

| | | | |
|---|---|---|---|
| EP | 39614 | * 11/1981 | ..... 52/293.1 |
| EP | 1 035 273 A1 | 9/2000 | |
| FR | 2 518 613 A1 | 6/1983 | |
| FR | 2566447 | * 12/1985 | ..... 52/169.7 |
| FR | 2 724 680 B1 | 3/1996 | |
| WO | WO 00/46456 A1 | 8/2000 | |

* cited by examiner

*Primary Examiner*—Carl D. Friedman
*Assistant Examiner*—Naoko Slack
(74) *Attorney, Agent, or Firm*—Rothwell, Figg, Ernst & Manbeck

(57) ABSTRACT

A process for the implementation of Civil Engineering works, swimming pools and water tanks in which, after digging in the grounds an excavation of suitable dimensions, are suitably set and wedged near the excavation walls, at a level on the bottom of the excavation and with the desired alignments, feet on which the elevated lower part of said panels will rest and be wedged, these feet having, on the outside of the work looking toward the grounds, a large opening above which are wedged chimneys that are fastened to the panels, a gully is set all around the outside of the work, above the chimneys and against the upper part of the panels, concrete or concrete mortar being poured into said gully to form the work upper clamping by filling up the chimneys and letting it overflow on the lower part of the panels, after having set inside the chimneys and in the upper gully the needed reinforcement irons, thus forming vertical pillars that will hold the work all around.

17 Claims, 10 Drawing Sheets

PROCESS FOR THE IMPLEMENTATION OF CIVIL ENGINEERING WORKS, SWIMMING POOLS AND WATER TANKS IN PARTICULAR, AND MEANS FOR ITS IMPLEMENTATION

BACKGROUND OF THE INVENTION

1. Field of the Invention

This invention relates essentially to a process for the construction of Civil Engineering works, such as swimming pools or water tanks in particular, installed on the grounds, that must comprise a wall or structure made of a mechanically-resistant reinforced concrete filled in situ by means of panels made, at least in part, of two sheets of suitable plastic material such as polypropylene and the like, held together by appropriate bracing structures, forming at least in part a dead form structure and cooperating in the construction of the work.

2. Description of the Related Art

Many processes and devices for the construction of such works using various dead form structures are already known.

Some processes use, for instance, dead form structures along the total height of the wall to be built, juxtaposed and assembled with one another by various means. Such form structures usually tend to be impractical, their versatility of use is extremely limited, they are too bulky for storage and transport purposes, and are not suitable overall for the construction of a perfectly watertight continuous concrete wall.

Other processes and devices use the conventional technique consisting in mounting a wall by means of hollow blocks which, for a swimming pool, can be made of polystyrene foam or the like. Such blocks are easy to use but the rigidity of the form structure before the setting of the concrete is problematic, the setting of the irons is difficult and the volume of such blocks is very high, which does not make for easy storage and transport.

In his prior patent FR 2 724 680, the applicant already described an improved panel forming dead form structure for the construction of such auto-stable works. This invention relates to an improvement of this technique aimed at promoting precision in its implementation, while reducing considerably the storage volume of the materials to be used, particularly that of the dead form panels, as well as greatly decreasing the volume of concrete needed to achieve the rigidity required in such construction.

SUMMARY OF THE INVENTION

The process according to this invention is different from those of the prior art in that, after digging in the grounds an excavation of appropriate dimensions, feet are set and suitably wedged on the excavation bottom, on a level and with the desired alignments, near the excavation walls. These feet comprise at least two elevated walls delimiting a passageway in and on which the lower part of said panels will be laid and wedged. Said feet are designed, on the outside of the work toward the grounds, with a large opening in which are wedged chimneys that will be fastened to the panels all the way up to the upper part of said panels. Above the chimneys and against the panels outer upper part, is set a gully that goes around the work. Concrete or concrete mortar is poured into said gully to form the upper clamping of the work by filling the chimneys and overflowing on the panels lower part, after having placed inside the chimneys and in the gully the necessary reinforcements irons, thus forming vertical pillars that will hold the work all around.

According to another characteristic of the process of this invention, the concrete for the work apron and the concrete for the pillars are poured simultaneously.

According to yet another characteristic of the process of this invention, the reinforcement irons of the pillars are interlocked with those of the upper clamping and of the apron before the concrete is poured.

This invention also comprises means for the implementation of the process described above, and particularly feet designed to stabilize the panels, characterized in that they are essentially in a pyramidal prismatic shape with, at their top, a large quadrangular opening in which can be inserted the wall of the chimneys through which will be poured the concrete forming the pillars, and comprising on one side two walls forming an elevated passageway over the base of said feet, the width of this passageway being fitted to receive the lower part of the panels.

Among the new means of this invention is the use of panels characterized in that they are formed by two sheets of an appropriate plastic material such as polypropylene and the like, linked and braced via a network of complementary pins and openings designed opposite one another on the inner faces of the two sheets and that come to interlock when said sheets are forcibly assembled. According to one embodiment, said sheets are designed with stiffening ribs in their inner face. In this case, such thin panels have a great rigidity together with a small volume, which greatly facilitates the storage and transport.

According to another embodiment, the panels may not be ribbed. Then their rigidity can result from the pouring of the concrete between the two panel sheets via the gully that goes around the upper part of the work.

The invention and its implementation will become more apparent from the following description, together with the accompanying drawings.

DETAILED DESCRIPTION OF THE PREFERRED EMBODIMENTS

Figure 1:
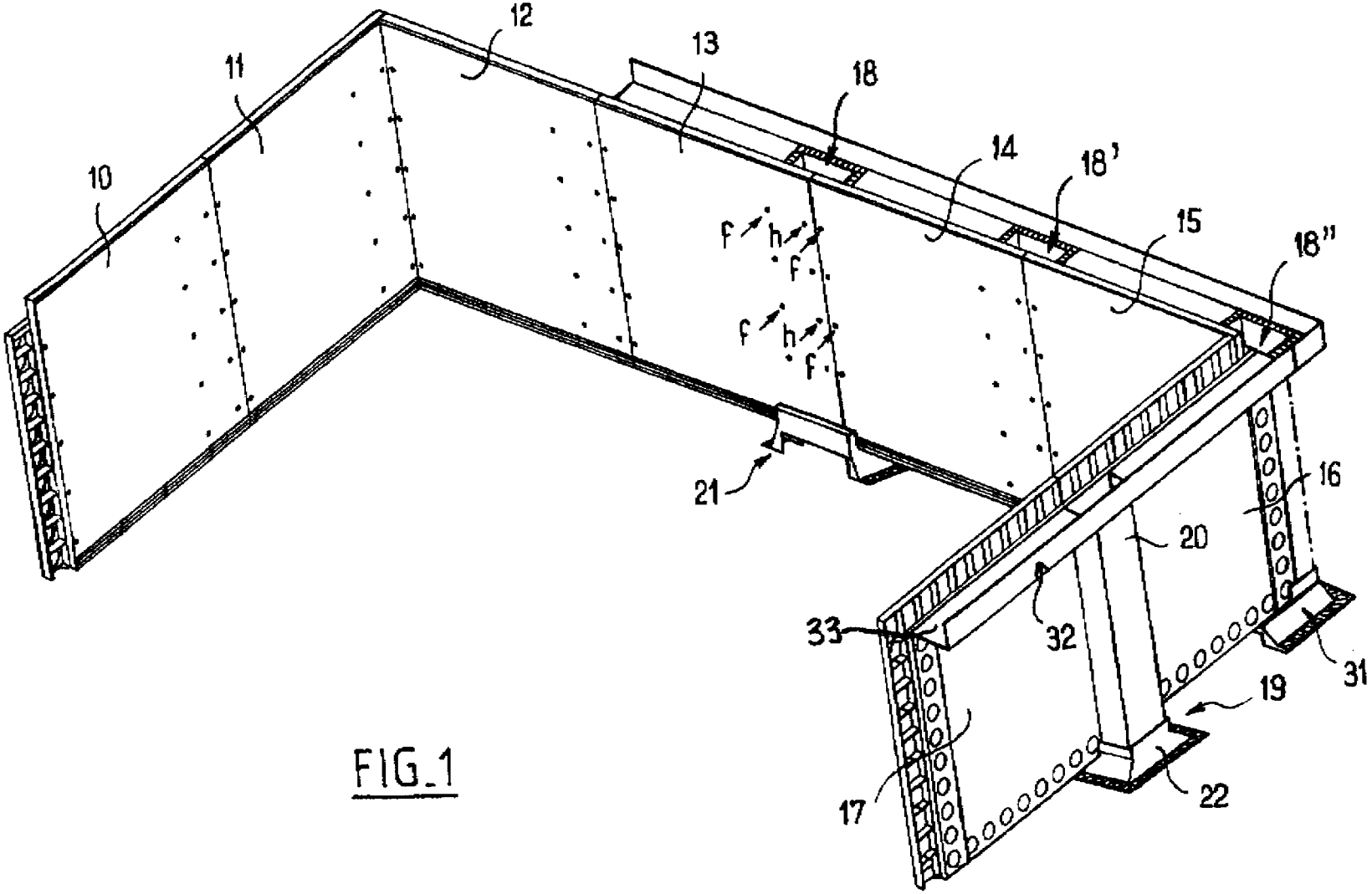
FIG. 1 is a diagram showing how the form structure is put together for the construction of a work according to this invention.

FIG. 1 shows a number of panels set side by side to form the beginning of a wall, that of a swimming pool for instance. The panels so arranged are set at the bottom of an excavation that was not represented to avoid overwriting the drawing. Eight panels referenced 10 to 17 are represented here. The panels 12 to 15 form, for instance, the small end side of a 4 m×8 m pool. In this case, the panels may be 1 m-wide each. Their height will depend on the desired depth for the pool, for instance 1.10 m. Also represented on FIG. 1 is the upper end of a chimney 18 of which the embodiment and characteristics of use will be detailed thereafter. On the right and in the front part of the FIG. 1 is shown a foot 19 of which the design and use will be detailed thereafter. Above the foot 19 is shown simplified in 20 another chimney; as will be more apparent from the following description, particularly in reference to FIG. 6, the chimney fastened on the outside of the panels cooperates with the foot 19 on which it is set and, at its top, with a gully through which the concrete will be poured. In 21 is also shown at the base of the chimney 18 the part, located inside the pool to be built, of a foot supporting the panels 13 and 14 at their junction. Such chimneys in which are poured the pillars of the pool primary structure are essentially designed for every panel junction and for every angle, as shown in 18' and 18" in FIG. 1, at the junction of the panels 14, 15 and in the angle between the panels 15 and 16.

Figure 2:
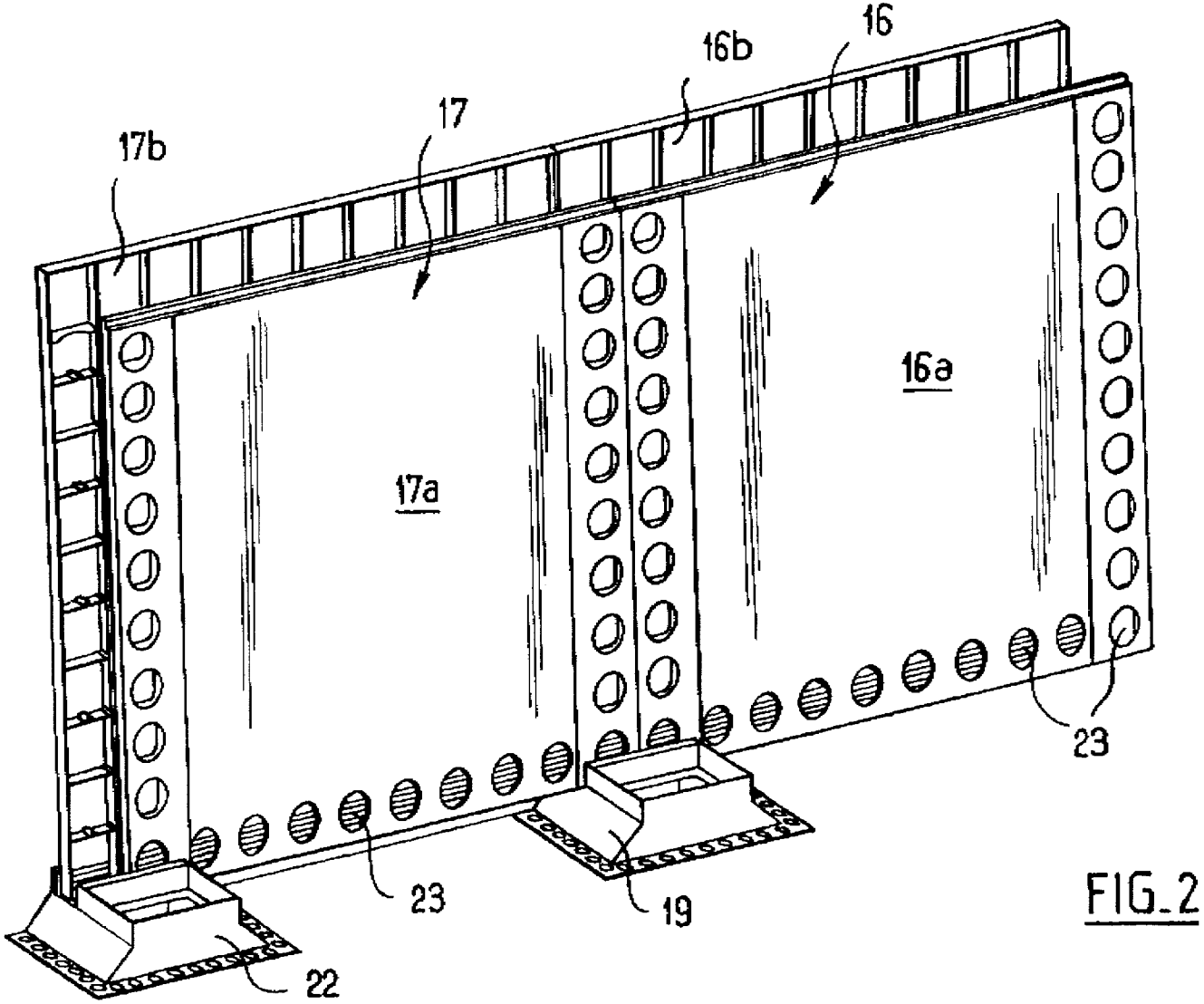
FIG. 2 is a perspective view of two panel elements set on their feet.

FIG. 2 shows more precisely and on a larger scale two panels such as 16 and 17 with the foot 19 set under the junction of these two panels. On the left, another foot 22 is shown supporting the extremity of the panel 17. FIG. 2 clearly shows that the sheet on the outside of the work, 16*a* for the panel 16 and 17*a* for the panel 17, is designed on its two lateral edges and on its lower edge with holes 23 that will facilitate a good anchorage of the panels by the concrete that will be poured to form the walls of the work, as will be explained thereafter. FIG. 2 also shows that the sheets 16*b* on the inside of the panel 16 and 17*b* on the panel 17 protrude laterally beyond the inner sheet and on one side (the left side on the drawing), while conversely the outer sheet protrudes laterally on the other side of the panel (right side on the drawing) beyond the inner sheet. This quincunx overlapping facilitates a good fixation and junction of the successive panels involved in forming the total wall of the work.

Figure 3:
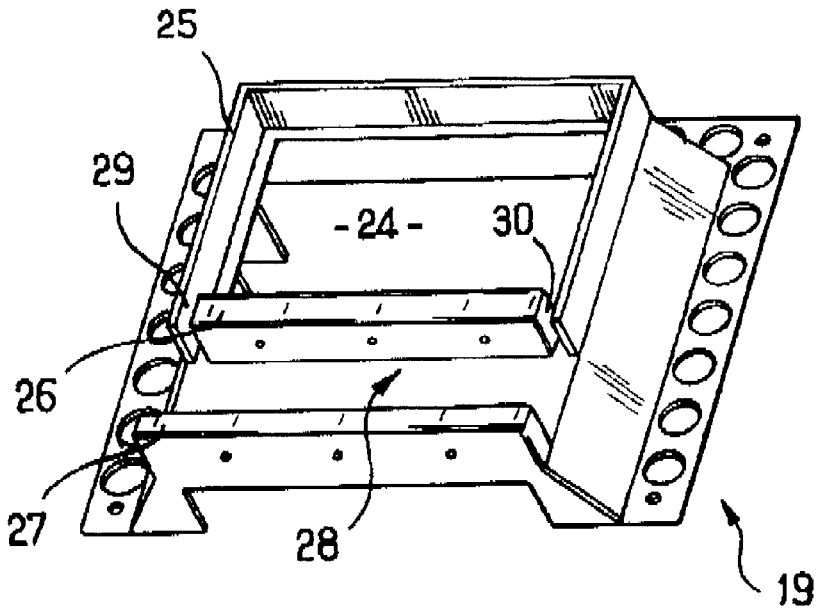
FIG. 3 is an enlarged perspective view of a foot such as shown in FIG. 2.

FIG. 3 shows a more precise description of a foot such as 19, 21 or 22 already mentioned. Such a foot, e.g. the foot 19, has a general prismatic pyramidal shape and its top displays a large opening 24, e.g. rectangular such as 200×200 mm. Said opening is lined on three sides by a U-shaped wall 25. The top of the U opens into the walls 26, 27 forming a passageway 28 fitted to receive the lower part of the panels such as 16 and 17. As appears clearly on FIG. 3, the base of the passageway 28 is elevated over the base of the foot 19, so that such panels as 16 and 17, when set on the feet, will leave under them a space to be filled by the concrete of the work, particularly in connection with the apron. FIG. 3 also shows that the wall 26 does not entirely close the opening of the U branch formed by the wall 25; this will provide a suitable blocking, as will be further described hereafter, of the base of the chimney used to pour the concrete and that will be set inside the opening 24. In FIG. 3, such spaces were referenced respectively as 29, 30. According to one embodiment, said feet can be made of a molded plastic material such as recycled polypropylene. The width of the passageway 28 is adjusted to the width of the panels; it can be, for instance, about 70-mm wide. The base of such passageway can be, for instance, 60-mm higher than the base of the foot, and the walls 26, 27 can be, for instance, about 40-mm. high for the setting and suitable adjustment of the panels on the feet.

Figure 4:
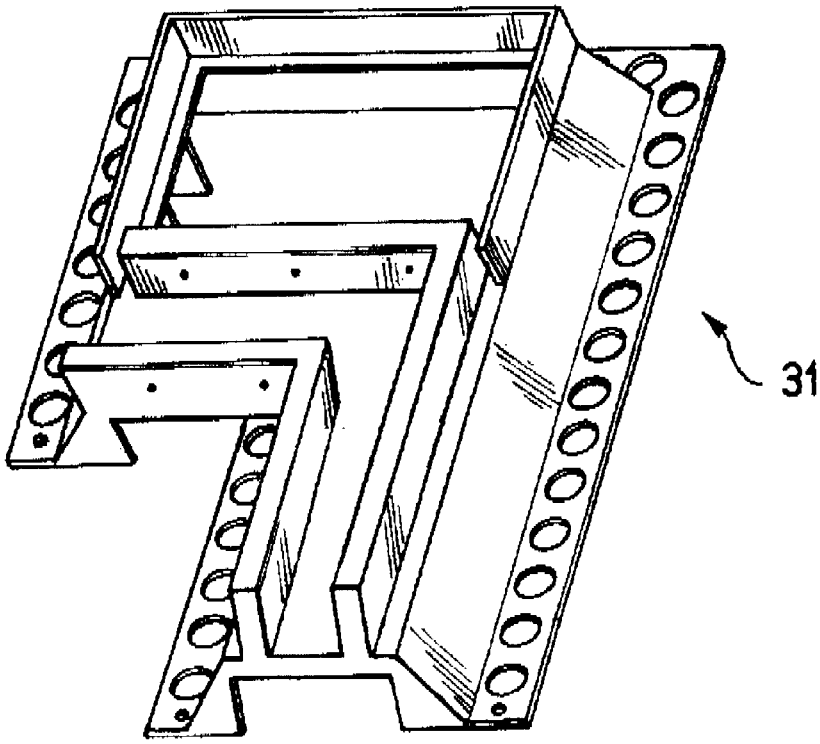
FIG. 4 shows another foot that could be used to hold two panels together in a construction angle.
Figure 5:
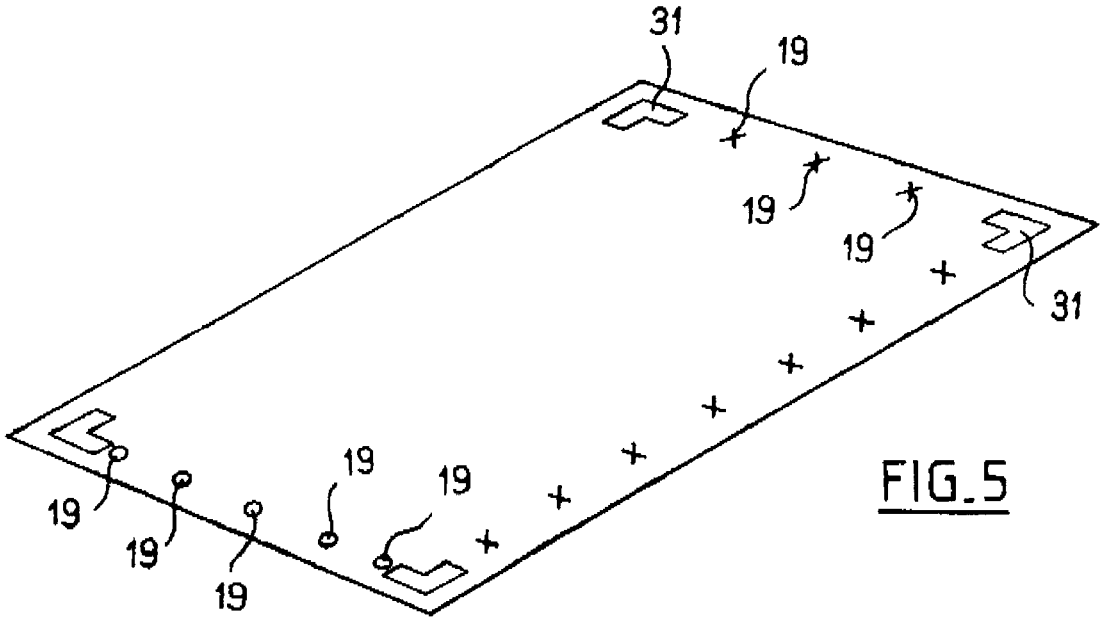
FIG. 5 is a very simplified view of the possible locations, on the bottom of the excavation, of the various feet that will receive the panels.

FIG. 4 shows a modified foot 31 that can be advantageously used in an angle of the work to receive the lower parts, oriented at 90°, of two angle panels. If angle feet such as illustrated in FIG. 5 are used, e.g. in the case of a 4 m×8 m (four meters×eight meters) rectangular swimming pool, it will be possible to use two such angle feet 31 with the three intermediary feet such as indicated in 19 separated by one-meter intervals to support the panels on that side. If such angle feet are not used, then, as illustrated for the other side, five feet such as 19 can also be used, also separated by one-meter intervals, with only a short protruding panel extremity at each angle. Another advantageous solution will consist of using in the angles the pillars formed in the hollow L-section chimneys (not represented) set on the outside of the structure on the angle bisector to recover the efforts in that angle; these pillars will anchor themselves in a foot opening such as 24, of which the section corresponds to the outside section of the L-shaped chimney.

Figure 6:
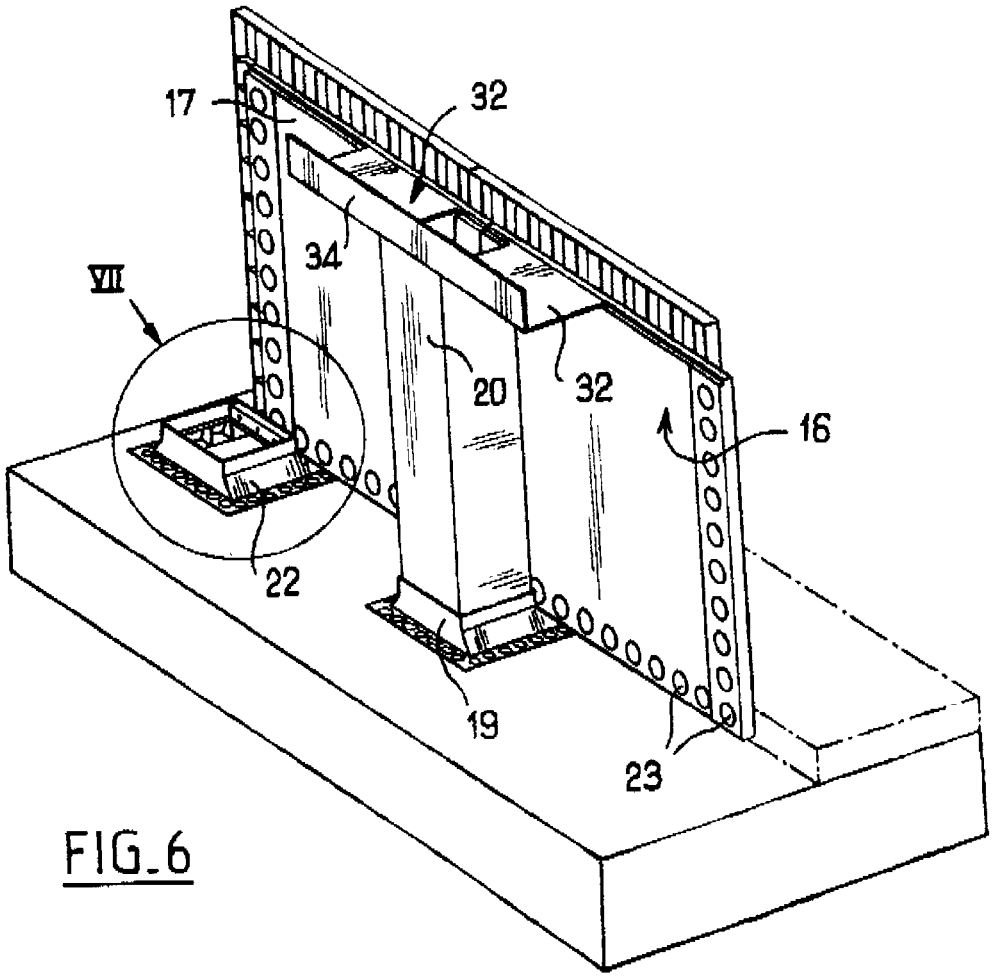
FIG. 6 is a perspective view showing more precisely than FIG. 1 how the form structure is set for the construction of the work.

Referring now to FIG. 6, a practical embodiment for the pouring of the concrete to achieve the work primary structure will be described in more details. FIG. 6 shows again the panels 16 and 17 of the previous drawings and of FIG. 2 in particular. The panels are suitably mounted on the feet previously set on the bottom of the excavation, after said feet were checked for horizontality, for suitable height and for the alignment of the passageways 28 that will receive the panels lower parts. Once the panels suitably adjusted, they can be temporarily wedged, with a spadeful of concrete for instance. Then, on the outside of the panels, chimneys such as 20 are introduced. Said chimneys can be formed with a cellular sheet folded in U, made for instance of polypropylene and having the suitable height. The base of such a chimney is inserted inside the wall 25 (FIG. 3) in the intervals 29, 30. Thus positioned, the chimney can be simply fastened from the inside of the work onto the panels by means of screws, for example as shown by the arrows f in FIG. 1, in the lateral walls of the chimney. That way, the volume of the excavation does not need to be notably higher than that of the hole made for the positioning of the work in the grounds. For a 4 m×8 m pool, a 4,8 m×8,8 m excavation will generally be suitable. The sheet forming the chimney wall may be, for instance, a 8-mm thick polypropylene sheet with a structure of the corrugated cardboard type.

Figure 7:
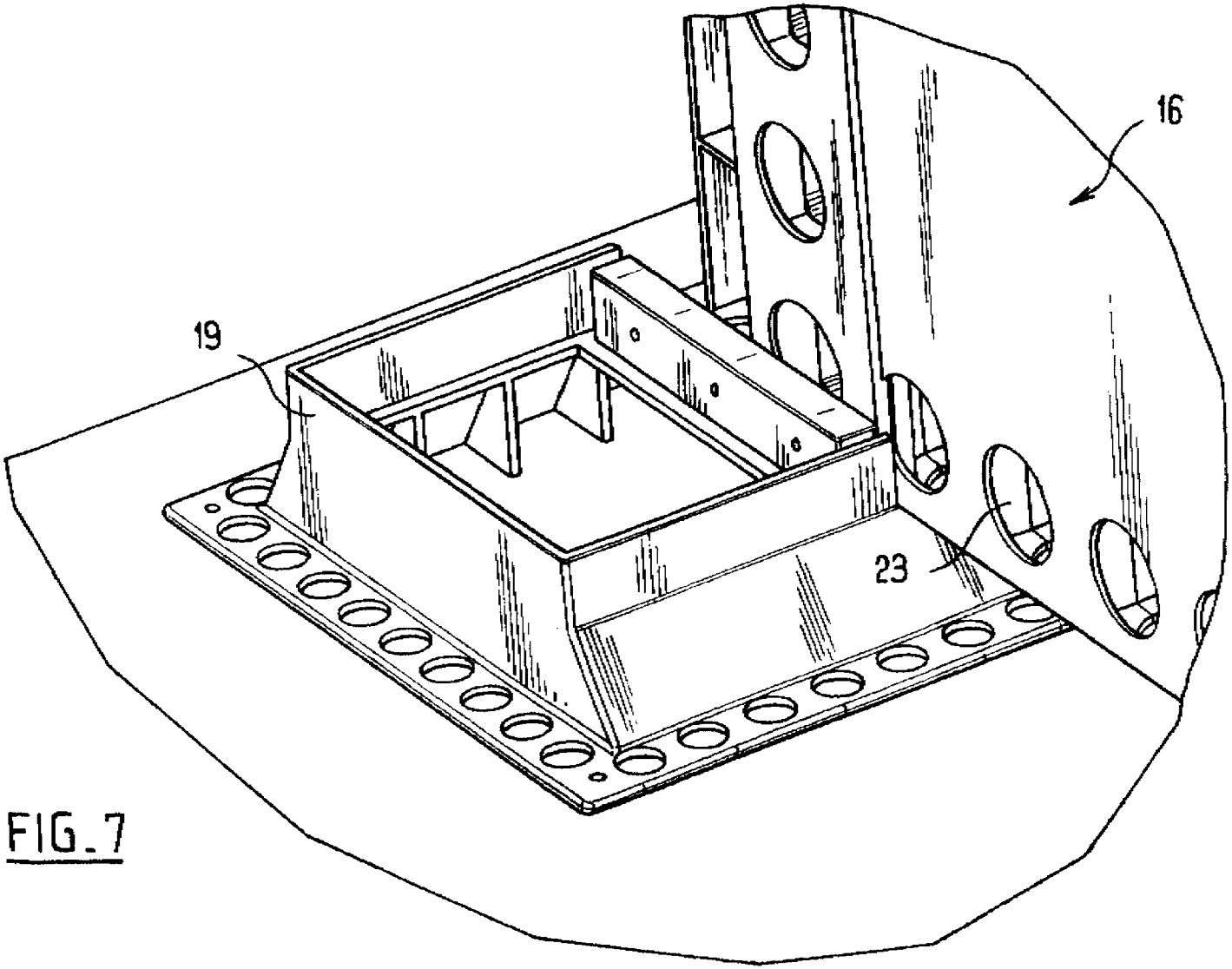
FIG. 7 is an enlarged view of the circled detail VII of FIG. 6.
Figure 9:
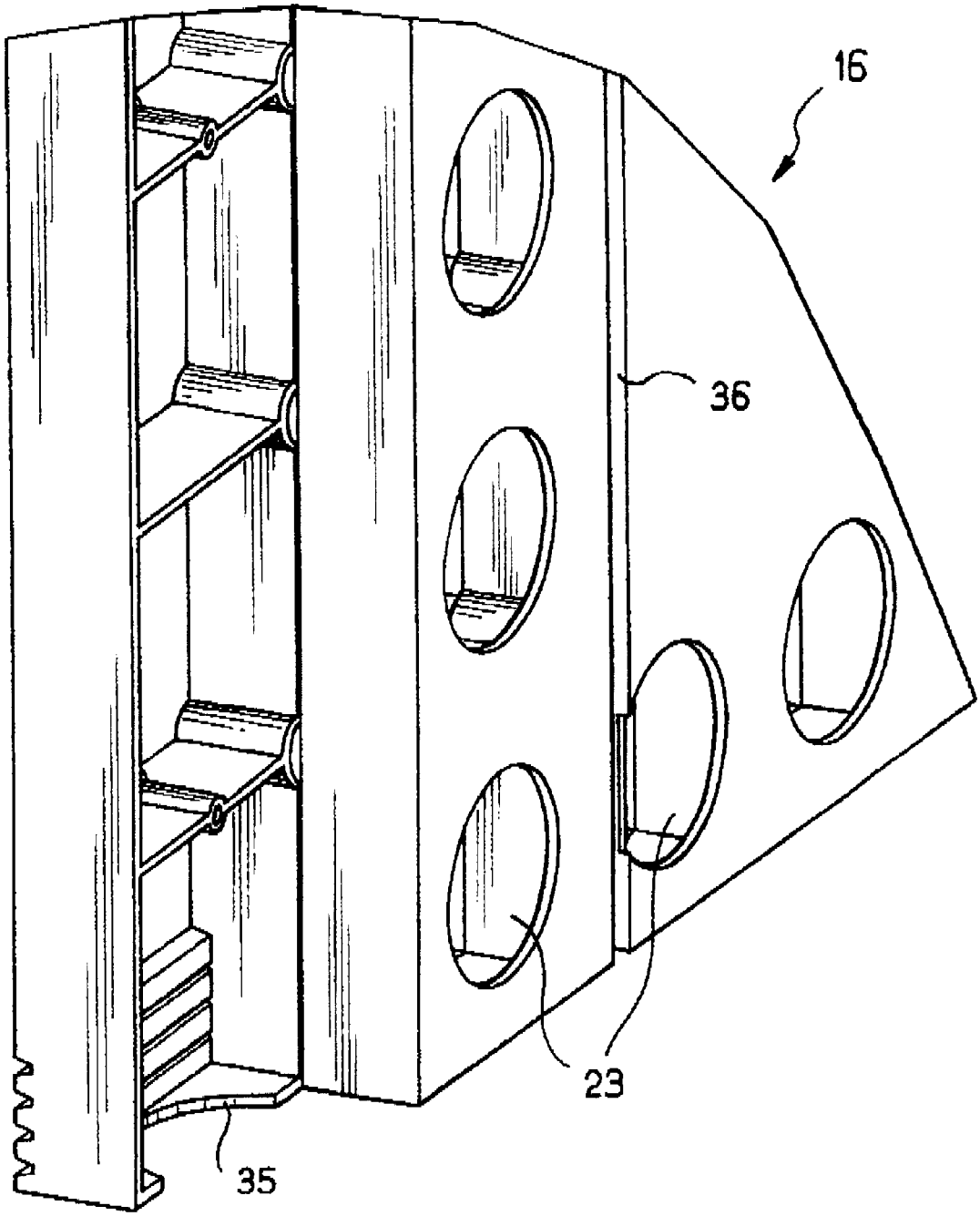
FIG. 9 shows a detail of the lower part of the panel angle of FIG. 8.

On the upper part of the panels, more specifically at the same level as the lower upper part of the inner sheet (lower than the outer one) of each panel, is then set a gully 32. This gully comprises a bottom wall 33 and a lateral wall 34 that will reach the same level as the upper part of the panel inner sheet. The bottom 33 of said gully is broken through at the location of the chimney to allow for the pouring of the concrete in said chimneys via the gully that goes all around the work. Inside this gully are the reinforcing irons [not represented] of the work upper clamping. In said chimneys are also introduced the reinforcing irons [not represented] that will be locked at their base with the apron irons. When all these pieces are so assembled, the concrete is poured in the gully 33, casting simultaneously the pillars, the upper clamping and the junction with the apron. Since the panels are elevated over the base of the feet, the concrete seeps under the panels and in the holes 23 on the outside, thus locking in the base of the panels while providing a seal with the concrete. FIG. 7 clearly shows that the concrete poured through the chimney by entering the inside of the foot 19 will seep everywhere under the base of the panel 16 and in the holes 23. FIG. 9 also shows that the locking of the panels base will be effective, due in particular to the holes 35 provided in the panels lower parts.

Figure 8:
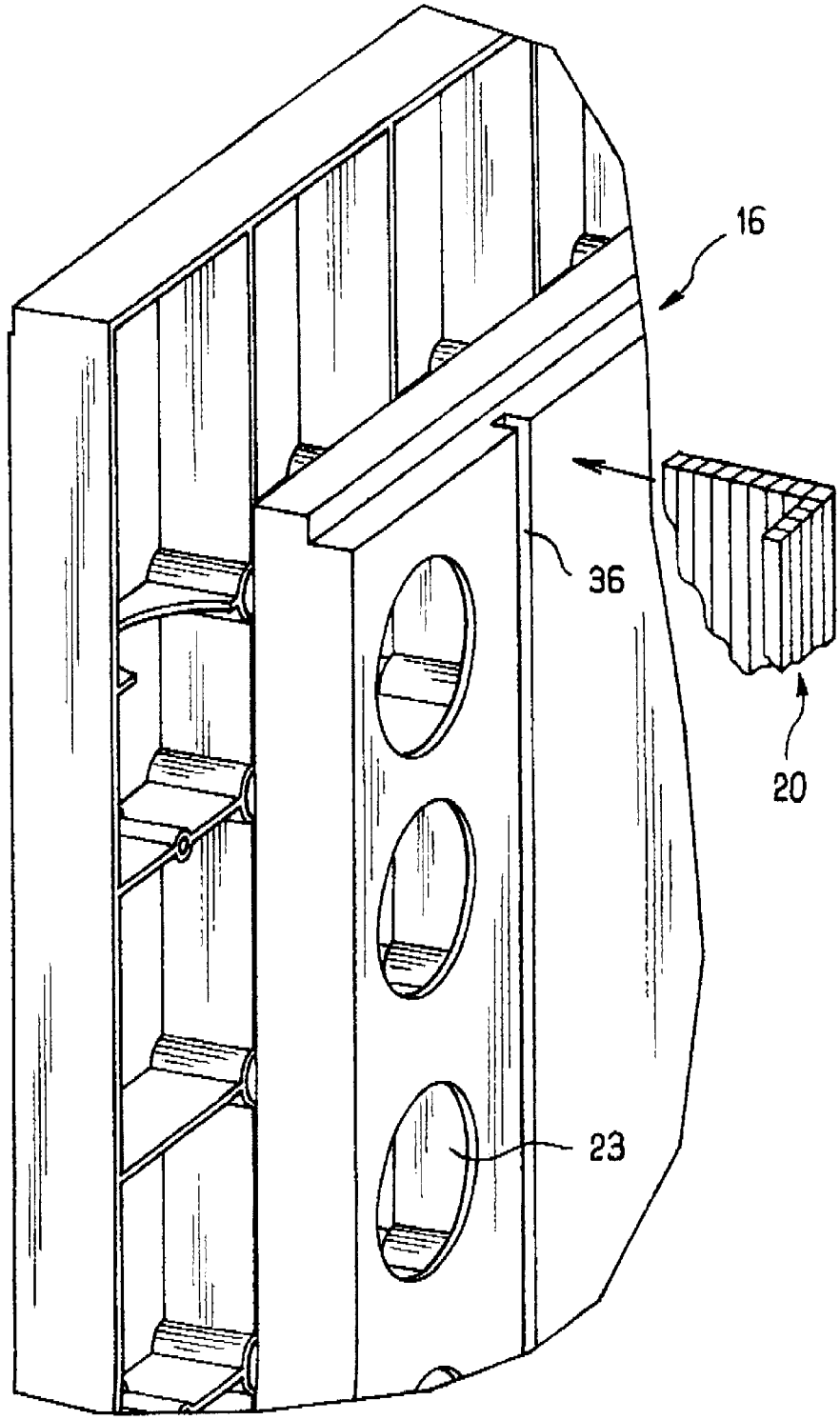
FIG. 8 is an enlarged view of a detail of the upper part of a panel angle.

As appears more clearly in FIG. 8, the outside of the panels such as 16, was designed with ribs 36 that will receive the lateral portion of the chimney 20. This will insure a precise positioning of that portion and will allow for the screwing, as indicated by the arrows f of FIG. 1, of the chimneys mounting screws into holes already marked leading to the ribs 36.

Figure 10:
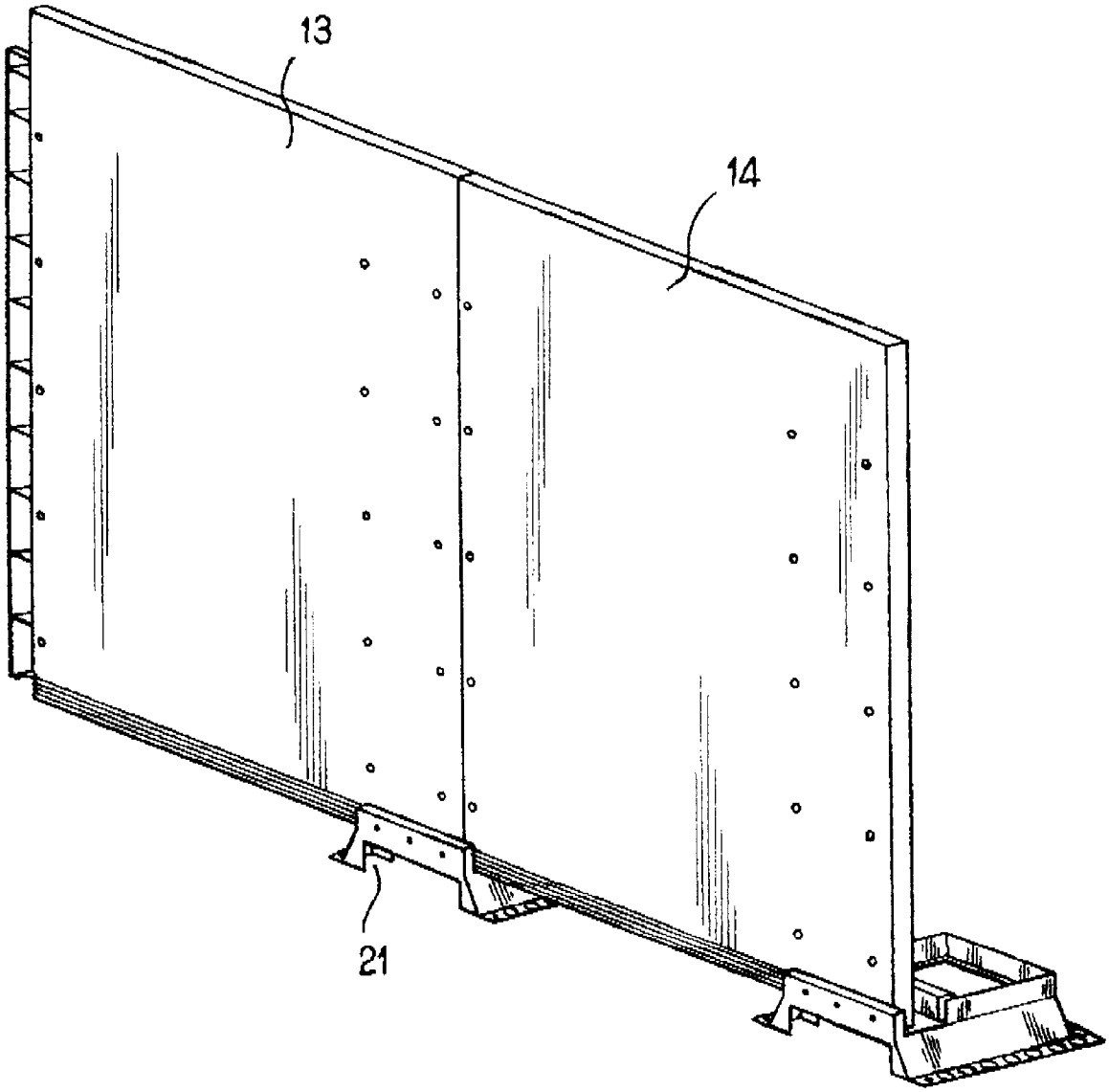
FIG. 10 shows, as in FIG. 2 but this time seen from the inside, two panels mounted on their feet.

FIG. 10 shows, seen from the inside, two panels such as 13, 14, set on two feet. On this inside face, the smooth panels can be provided with any usual sealing coat such as a liner.

Figure 11:
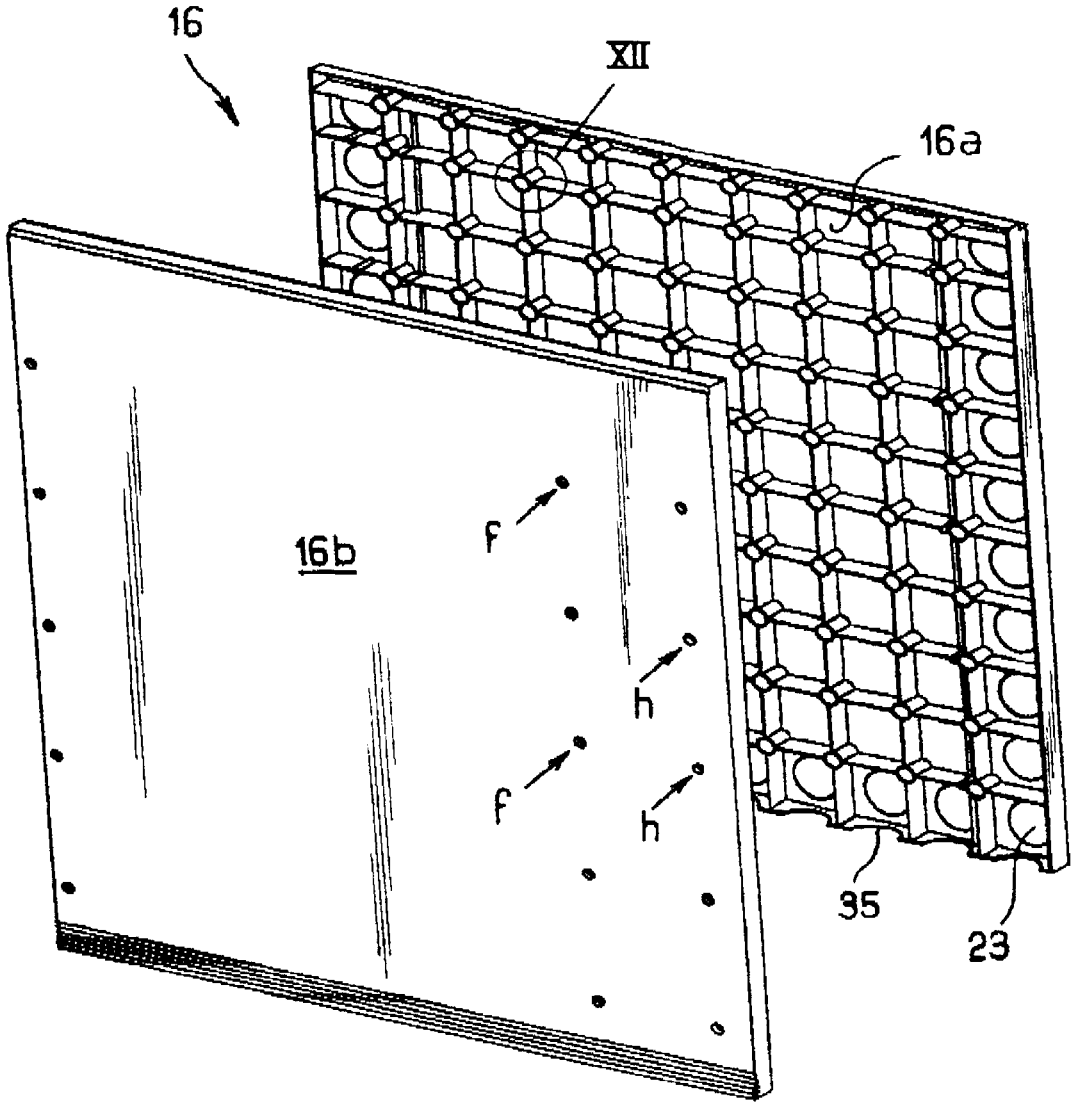
FIG. 11 is an exploded perspective view of the formation of a panel such as illustrated in the previous Figures.
Figure 12:
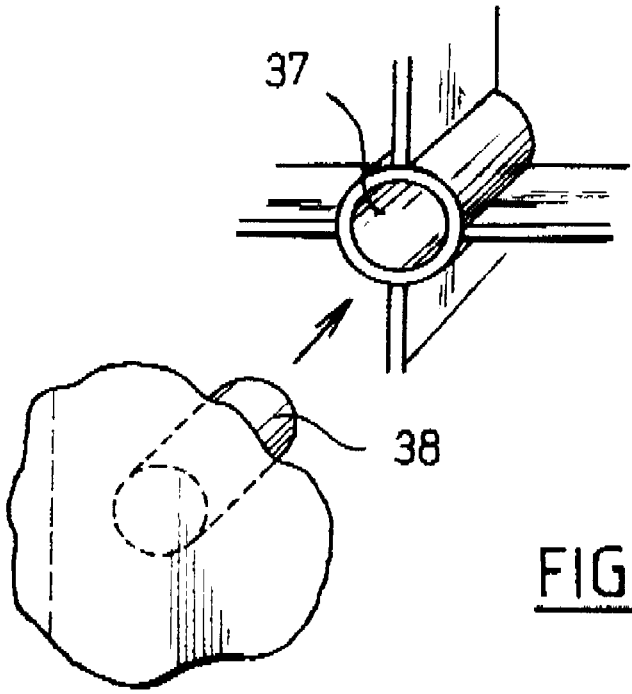
FIG. 12 is an enlarged view of the detail XII circled in FIG. 11 and of the cooperating pin integral with the front panel sheet that is not visible on FIG. 11.

FIGS. 11 and 12 show a panel particularly well adapted to the embodiment of this invention. This panel, such as the panel 16 already described, consists of two sheets, respectively an inner sheet 16*b* and an outer sheet 16*a*, each sheet being ribbed to form a network of squares. The nodes of such network display on one side the openings 37 and on the other the pins 38 that can be force-fitted into the openings 37. When the two panel sheets are assembled, the resulting panel is quite rigid. This enables to reduce the panel thickness to, for instance, 70 mm. As previously shown, there is a shift in position between the inner sheet 16*b* and the outer sheet 16*a* and the outer sheet is lower that the inner one, to make room for the setting of the gully that will pour the upper reinforcing clamping of the work. The edges of the juxtaposed panels thus partly overlap and can be fastened by any means such as screws at the level of the arrows h (FIGS. 1 and 11).

Figure 13:
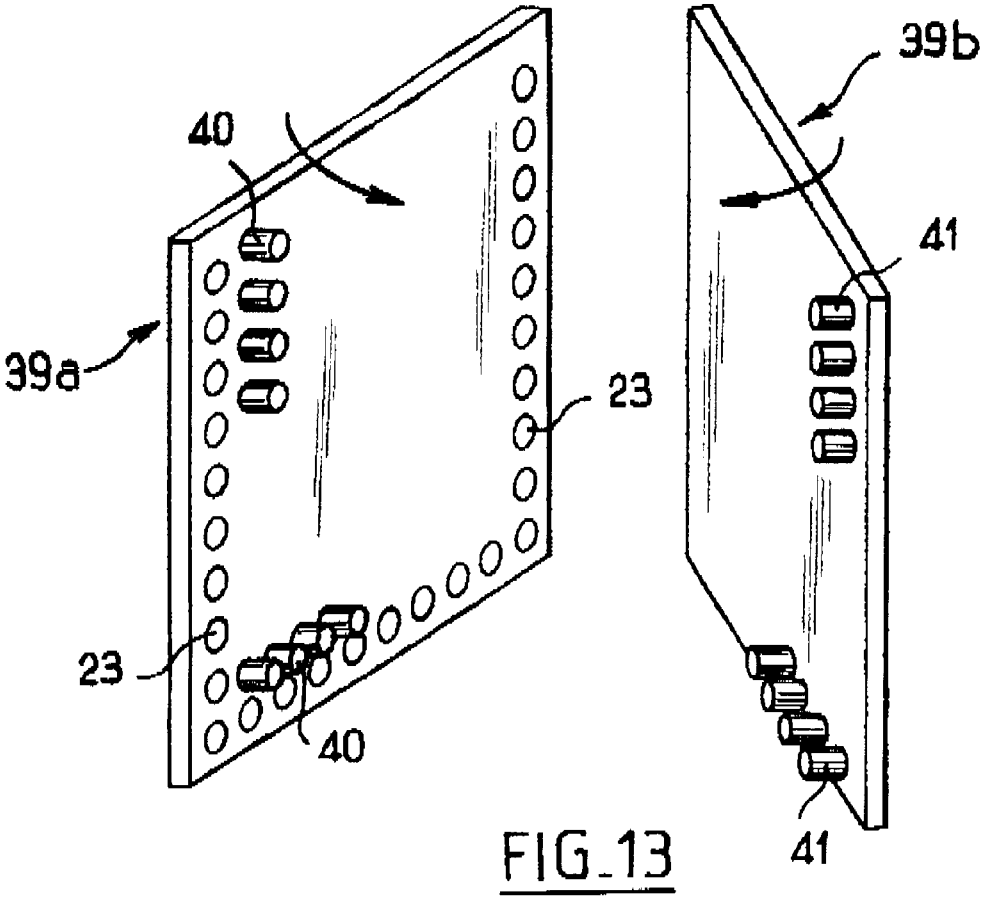
FIG. 13 is a diagram showing two separate non-ribbed sheets that may form another possible panel of this invention.

According to a variant of implementation sketchily shown in FIG. 13, the two sheets of a panel such as 39*a* on the outside and 39*b* on the inside do not need to be ribbed and can be simply interlinked by means of bracing cylinders that will enter one another. Aside from this, the dimensions will be the same, the panels will display the same overlap on the edges of the two sheets and the same holes to insure the locking in the concrete.

In the illustrated panel, the network pitch will advantageously be about 100 mm. In the case of the panel of FIGS. 11 and 12, the diameter of the openings and of the pins 37, 38 may be about 20 to 30 mm. In the case represented in FIG. 13, the cylinder diameter can be about 60 to 70 mm. If the panels are not ribbed, some concrete mortar will be poured inside the panels to impart them with the required rigidity, the pouring being done through the gully 32 already described. In this case, a metal reinforcement (not represented) will advantageously be inserted between the two panel sheets, before the panels are interconnected by means of their pins or cooperating bracing structures 40, 41.

Some of the important advantages of a process according to this invention are the ease and speed of its implementation, the small volume of the materials needed, particularly the small volume of the form work walls and of the concrete to be used, three to four times less than the volume required with the known techniques. Moreover, this invention allows the construction of auto-stable works without having to resort to outer force jambs.

Such advantages are obtained because of the structure of the concrete, "monobloc" so to speak, that results from the implementation of this invention, said structure comprising the apron, the pillars cast in the chimneys, and the upper clamping, all these parts being suitably reinforced and the reinforcements being locked and sunk in the concrete mortar. When panels such as described in reference to FIG. 13 are used, said panels are then integral with the concrete structure.

What is claimed is:

1. Process for the implementation of Civil Engineering works such as swimming pools and water tanks, installed on the grounds, that must comprise a wall made of a mechanically-resistant concrete filled in situ by means of panels made, at least in part, of two sheets of an appropriate plastic material, held together by bracing structures, forming at least in part a dead form structure and cooperating in the construction of the work, in an excavation, comprising:

setting feet on a level, on the bottom of the excavation and with the desired alignments, near walls of the excavation, said feet comprising at least two elevated walls forming a passageway in which a lower part of said panels will rest and be locked;

wedging said feet on the level;

providing on the feet, on an outside of the work looking toward the grounds, a large opening;

wedging chimneys, that are fastened to the panels all the way to an upper part of said panels, into the large opening;

setting a gully all around the work, above the chimneys and against the upper part of the panels, pouring concrete mortar into said gully to form the work upper clamping;

placing reinforcement irons in the chimneys and in the upper gully;

filling up the chimneys and overflowing on the lower part of the panels, thus forming vertical pillars that will hold the work all around.

2. Process according to claim 1, comprising further pouring concrete for a work apron and for the pillars simultaneously.

3. Process according to claim 2, comprising further locking the reinforcement irons of the pillars, of the upper clamping and of the apron together before the concrete is poured.

4. Panel stabilizing feet for the implementation of Civil Engineering works such as swimming pools and water tanks, installed on the grounds, that must comprise a wall made of a mechanically-resistant concrete filled in situ by means of panels made, at least in part, of two sheets of an appropriate plastic material, held together by bracing structures, forming at least in part a dead form structure and cooperating in the construction of the work, dug in an excavation, comprising:

feet suitably set and wedged on a level, on a bottom of the excavation and with the desired alignments, near walls of the excavation, said feet comprising at least two elevated walls forming a passageway in which a lower part of said panels will rest and be locked, these feet having, on an outside of the work looking toward the grounds, a large opening in which are wedged chimneys that are fastened to the panels all the way to an upper part of said panels, wherein said feet are designed with an essentially prismatic pyramidal shape with, at a top, a large quadrangular opening in which can be inserted a wall of said chimneys used to pour concrete for the pillars, said feet comprising on one side two walls forming an passageway elevated over a base of the feet, a width of said passageway being fitted to receive the lower part of the panels.

5. Panels for the implementation of Civil Engineering works such as swimming pools and water tanks, installed on the grounds, that must comprise a wall made of a mechanically-resistant concrete filled in situ by means of panels made, at least in part, of two sheets of an appropriate plastic material, held together by bracing structures, forming at least in part a dead form structure and cooperating in the construction of the work, dug in an excavation, comprising:

feet suitably set and wedged on a level, on a bottom of the excavation and with the desired alignments, near walls of the excavation, said feet comprising at least two elevated walls forming a passageway in which a lower part of said panels will rest and be locked, these feet having, on an outside of the work looking toward the grounds, a large opening in which are wedged chimneys that are fastened to the panels all the way to an upper part of said panels, wherein said panels consist of two sheets of a plastic material, linked and braced by means of two networks of pins opposite one another on inner faces of the two sheets that interlock when the two sheets are force-fitted.

6. Panels according to claim 5, wherein said sheets comprise stiffening ribs on the inner face.

7. Panels according to the claim 5, wherein the panel sheet on the outside of the work is designed, on lateral and lower edges, with holes that open into the panel inner space.

8. Panels according to claim 5 wherein the sheet forming an inner side of the panel is higher than the sheet forming an outer side of said panel.

9. Panels according to claim 5, wherein the two panel sheets are assembled so that an inner sheet protrudes at a top and on one side of an outer sheet, while the outer sheet protrudes on an other side of the panel.

10. Panels according to claim 5, wherein the two sheets of said panel are so assembled that the two sheets contain between them a metal reinforcement.

11. Panels for the implementation of Civil Engineering works such as swimming pools and water tanks, installed on the grounds, that must comprise a wall made of a mechanically-resistant concrete filled in situ by means of panels made, at least in part, of two sheets of an appropriate plastic material, held together by bracing structures, forming at least in part a dead form structure and cooperating in the construction of the work, dug in an excavation, comprising:

feet suitably set and wedged on a level, on a bottom of the excavation and with the desired alignments, near walls of the excavation, said feet comprising at least two elevated walls forming a passageway in which a lower part of said panels will rest and be locked, these feet having, on the outside of the work looking toward the grounds, a large opening in which are wedged chimneys that are fastened to the panels all the way to an upper part of said panels, wherein said panels consist of two sheets of a plastic material, linked and braced by means of two networks of pins and openings opposite one another on inner faces of the two sheets that interlock when the two sheets are force-fitted.

12. Panels according to claim 11, wherein said sheets comprise stiffening ribs on the inner face.

13. Panels according to claim 12, characterized in that said pins and holes are designed at nodes of the stiffening ribs.

14. Panels according to the claim 11, wherein the panel sheet on the outside of the work is designed, on lateral and lower edges, with holes that open into the panel inner space.

15. Panels according to claim 11 wherein the sheet forming an inner side of the panel is higher than the sheet forming an outer side of said panel.

16. Panels according to claim 11, wherein the two panel sheets are assembled so that an inner sheet protrudes at a top and on one side of an outer sheet, while the outer sheet protrudes on an other side of the panel.

17. Panels according to claim 11, wherein the two sheets of said panel are so assembled that the two sheets contain between them a metal reinforcement.

* * * * *